US009222400B2

(12) United States Patent
Kaulen et al.

(10) Patent No.: US 9,222,400 B2
(45) Date of Patent: Dec. 29, 2015

(54) LIQUID-COOLED INTERNAL COMBUSTION ENGINE WITH AFTERRUN COOLING, AND METHOD FOR OPERATING AN INTERNAL COMBUSTION ENGINE OF SAID TYPE

(71) Applicant: Ford Global Technologies, LLC, Dearborn, MI (US)

(72) Inventors: Wilfried Kaulen, Weilerswist (DE); Zoltan Nyiregyhazi, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 135 days.

(21) Appl. No.: 13/903,911

(22) Filed: May 28, 2013

(65) Prior Publication Data

US 2013/0333643 A1 Dec. 19, 2013

(30) Foreign Application Priority Data

Jun. 19, 2012 (DE) ..... 10 2012 210 320

(51) Int. Cl.
*F01P 7/14* (2006.01)
*F02F 1/24* (2006.01)
*F01P 11/02* (2006.01)

(52) U.S. Cl.
CPC . *F01P 7/14* (2013.01); *F02F 1/243* (2013.01); *F01P 11/0285* (2013.01); *F01P 2007/146* (2013.01); *F01P 2031/30* (2013.01); *F01P 2060/12* (2013.01)

(58) Field of Classification Search
CPC ..... F01P 7/14; F01P 3/12; F01P 7/16; F01P 5/14; F01P 2007/146; F01P 2031/30; F01P 2060/00; F01P 2060/02; F01P 2060/04; F01P 2060/12
USPC ..... 123/41.08, 41.02, 41.31, 41.44; 60/605.1, 605.2, 605.3
See application file for complete search history.

(56) References Cited

U.S. PATENT DOCUMENTS 3,827,236 A * 8/1974 Rust ..... 60/605.1
4,157,744 A * 6/1979 Capriotti ..... 184/6.3

(Continued)

FOREIGN PATENT DOCUMENTS

DE 102004058865 A1 6/2006
DE 102006010470 A1 9/2007

(Continued)

*Primary Examiner* — Lindsay Low
*Assistant Examiner* — Grant Moubry
(74) *Attorney, Agent, or Firm* — Julia Voutyras; Alleman Hall McCoy Russell & Tuttle LLP

(57) ABSTRACT

An engine comprises a cylinder head connected to a cylinder block; a cooling circuit including a pump, a heat exchanger, and a ventilation vessel; a liquid-cooled component, connected into the cooling circuit by a connecting line and arranged between the pump and the ventilation vessel, which is cooled when the engine is not in operation; and a valve which is self-controlling as a function of coolant pressure arranged in the connecting line between the pump and the ventilation vessel, the valve adjustable between a first working position having a first, relatively small cross section of the connecting line, and a second working position, having a second, relatively large cross section of the connecting line, the valve controlling coolant throughput, wherein when the engine is not in operation and coolant pressure is reduced, the valve is in the second working position to provide an enlarged flow cross section.

19 Claims, 3 Drawing Sheets

(56) References Cited

U.S. PATENT DOCUMENTS

| | | | | |
|---|---|---|---|---|
| 4,389,984 | A * | 6/1983 | Destrampe | 123/196 S |
| 4,561,387 | A | 12/1985 | Körkemeier et al. | |
| 4,608,827 | A * | 9/1986 | Hasegawa et al. | 60/605.1 |
| 4,739,619 | A * | 4/1988 | Koerkemeier | 60/605.3 |
| 4,829,939 | A * | 5/1989 | Veenemans et al. | 123/41.29 |
| 4,884,406 | A * | 12/1989 | Kawamura | 60/605.3 |
| 4,958,600 | A | 9/1990 | Janthur | |
| 4,977,743 | A * | 12/1990 | Aihara et al. | 60/605.3 |
| 6,688,104 | B2 * | 2/2004 | Baeuerle et al. | 60/608 |
| 2004/0187805 | A1 * | 9/2004 | Arisawa et al. | 123/41.14 |
| 2011/0180026 | A1 * | 7/2011 | Heusler | 123/41.44 |
| 2013/0206085 | A1 | 8/2013 | Adam et al. | |

FOREIGN PATENT DOCUMENTS

| | | | |
|---|---|---|---|
| DE | 102006044680 | A1 | 4/2008 |
| DE | 102007025149 | A1 | 12/2008 |
| DE | 102008011257 | A1 | 9/2009 |
| DE | 102010005824 | A1 | 7/2011 |
| DE | 102010001321 | A1 | 8/2011 |
| EP | 1384857 | A2 | 1/2004 |
| EP | 1923548 | A2 | 5/2008 |

* cited by examiner

LIQUID-COOLED INTERNAL COMBUSTION ENGINE WITH AFTERRUN COOLING, AND METHOD FOR OPERATING AN INTERNAL COMBUSTION ENGINE OF SAID TYPE

CROSS REFERENCE TO RELATED APPLICATIONS

The present application claims priority to German Patent Application 102012210320.1, filed on Jun. 19, 2012, the entire contents of which are hereby incorporated by reference for all purposes.

FIELD

The disclosure relates to a liquid-cooled internal combustion engine.

BACKGROUND AND SUMMARY

To form the individual cylinders of an internal combustion engine, the at least one cylinder head is connected, at an assembly end side, to a cylinder block. To hold the pistons or the cylinder liners, the cylinder block, which at least jointly forms the crankcase, has a corresponding number of cylinder bores. The pistons are guided in the cylinder liners in an axially movable fashion and form, together with the cylinder liners and the cylinder head, the combustion chambers of the internal combustion engine.

To keep the thermal loading of the internal combustion engine within limits, it is increasingly common for a liquid-type cooling arrangement to be provided, hereinafter also referred to as engine cooling arrangement. It is basically also possible for the cooling arrangement to take the form of an air-type cooling arrangement. However, since significantly greater amounts of heat can be dissipated by means of a liquid-type cooling arrangement, internal combustion engines are preferably equipped with a liquid-type cooling arrangement. The internal combustion engine according to the disclosure is also a liquid-cooled internal combustion engine.

The formation of a liquid-type cooling arrangement requires that the at least one cylinder head and/or the cylinder block be equipped with at least one coolant jacket, that is to say requires the provision of coolant ducts which conduct the coolant through the cylinder head or block, which entails a complex structure. Here, the mechanically and thermally highly loaded cylinder head or block is firstly weakened in terms of its strength as a result of the provision of the coolant ducts. Secondly, the heat need not firstly be conducted to the surface to be able to be dissipated, as is the case with the air-type cooling arrangement. The heat is dissipated to the coolant, generally water provided with additives, already in the interior of the cylinder head or block. Here, the coolant is conveyed, such that it circulates, by means of a pump which is arranged in the cooling circuit and which is generally mechanically driven by means of a traction mechanism drive. The heat dissipated to the coolant is discharged from the interior of the cylinder head or block in this way, and is extracted from the coolant again in a heat exchanger. A ventilation vessel provided in the cooling circuit serves for ventilating the coolant or the circuit.

Liquid-cooled components of the internal combustion engine which are connected into the cooling circuit of the internal combustion engine by means of a connecting line and which require afterrun cooling when the internal combustion engine is not in operation, that is to say when the coolant pump is deactivated, have proven to be a problem; such components include for example an exhaust-gas turbocharger provided for the supercharging of the internal combustion engine, or the liquid-cooled bearing housing of said exhaust-gas turbocharger. This problem will be explained in more detail below on the basis of the example of a liquid-cooled bearing housing of an exhaust-gas turbocharger.

According to previous systems, internal combustion engines are ever more commonly being supercharged, wherein supercharging is primarily a method of increasing power, in which the air required for the combustion process in the engine is compressed. The economical significance of said engines for the automobile industry is ever increasing.

For supercharging, use is generally made of an exhaust-gas turbocharger, in which a compressor and a turbine are arranged on the same shaft. The hot exhaust-gas flow is supplied to the turbine and expands in the turbine with a release of energy, as a result of which the shaft, which is mounted in a bearing housing, is set in rotation. The energy supplied by the exhaust-gas flow to the turbine and ultimately to the shaft is used for driving the compressor which is likewise arranged on the shaft. The compressor delivers and compresses the charge air supplied to it, as a result of which supercharging of the cylinders is obtained.

A supercharged internal combustion engine is thermally more highly loaded, owing to the increased mean pressure, than a conventional naturally aspirated engine, and therefore also places increased demands on the cooling arrangement, for which reason in particular supercharged internal combustion engines are increasingly commonly being equipped with a liquid-type cooling arrangement.

Like the internal combustion engine itself, the turbine of an exhaust-gas turbocharger is likewise thermally highly loaded. As a result, the turbine housing is typically produced from heat-resistant, often nickel-containing material, or may be equipped with a liquid-type cooling arrangement in order to be able to use less heat-resistant materials. The latter leads to considerable cost advantages. EP 1 384 857 A2 and the German laid-open specification DE 10 2008 011 257 A1 describe liquid-cooled turbines and turbine housings.

The hot exhaust gas of the supercharged internal combustion engine also leads to high thermal loading of the bearing housing and consequently of the bearing of the charger shaft. Associated with this is the introduction of a correspondingly large amount of heat into the oil which is supplied to the bearing for the purpose of lubrication. On account of the high rotational speed of the charger shaft, the bearing is formed generally not as a rolling bearing but rather as a plain bearing. As a result of the relative movement between the shaft and the bearing housing, a hydrodynamic lubricating film, which is capable of supporting loads, forms between the shaft and the bearing bore.

The oil should not exceed a maximum admissible temperature, because the viscosity decreases with increasing temperature, and the friction characteristics are impaired when a certain temperature is exceeded. Too high an oil temperature also accelerates the aging of the oil, wherein the lubricating characteristics of the oil are also impaired. Both of these phenomena shorten the service intervals for oil changes and can pose a risk to the functional capability of the bearing, wherein even irreversible destruction of the bearing and therefore of the turbocharger is possible.

For the above reasons, the bearing housing of a turbocharger is commonly equipped with a liquid-type cooling arrangement. Here, a distinction is made between the liquid-type cooling arrangement of the bearing housing and the abovementioned liquid-type cooling arrangement of the turbine housing. Nevertheless, the two liquid-type cooling arrangements may—if appropriate only intermittently—be connected to one another, that is to say communicate with one another.

In contrast to the engine cooling or cooling of the turbine housing, the cooling of the bearing housing may be maintained even when the vehicle has been shut down, that is to say the internal combustion engine has been switched off, at least for a certain period of time after the internal combustion engine has been switched off in order reliably to prevent irreversible damage as a result of thermal overloading. The bearing housing is thus a liquid-cooled component which requires afterrun cooling when the internal combustion engine is not in operation.

This may basically be realized by means of an additional, electrically operated pump to which electricity is supplied for example by the on-board battery, which pump conveys coolant via a connecting line through the bearing housing when the internal combustion engine has been switched off and thereby ensures cooling of the bearing housing and of the bearing even when the internal combustion engine is not in operation. The provision of an additional pump is however a relatively expensive measure.

Also known are concepts which dispense with an additional pump. The German patent DE 34 07 521 C1 describes such a liquid-type cooling system for an internal combustion engine. Here, a rising line is laid through the bearing housing of the exhaust-gas turbocharger, which rising line functions as a connecting line and leads through the bearing housing from the cooling circuit of the engine cooling arrangement to the ventilation vessel. The delivery of the coolant when the internal combustion engine is switched off is realized by the so-called thermosiphon effect, which is based substantially on two mechanisms.

Owing to the introduction of heat—which continues even when the internal combustion engine is switched off—from the heated bearing housing into the coolant situated in the rising line, the coolant temperature increases, as a result of which the density of the coolant decreases and the volume taken up by the coolant increases. Superheating of the coolant may furthermore lead to a partial evaporation of coolant, such that coolant passes into the gaseous phase. In both cases, the coolant takes up a larger volume, as a result of which ultimately further coolant is displaced, that is to say conveyed, in the direction of the ventilation vessel.

The formation of the cooling arrangement of the bearing housing using a rising line and utilizing the thermosiphon effect however does not lead to a supply of coolant to the bearing housing according to demand, which yields disadvantages.

Without further measures, coolant will be conveyed via the rising line through the bearing housing into the ventilation vessel even during the warm-up phase after a cold start, even though cooling of the bearing is not required at this time. The undesired conveying of coolant also opposes the desired fast warm-up of the internal combustion engine. For the reasons stated above, DE 34 07 521 C1 provides a solenoid valve in the rising line between the bearing housing and the ventilation vessel, which solenoid valve is opened or open only when the internal combustion engine is not in operation. Furthermore, during the warm-up phase of the internal combustion engine, the bearing housing is separated from the engine-cooling arrangement itself by means of a thermostat valve in order to prevent cold coolant from the bearing housing being admixed to the cooling circuit of the internal combustion engine during the warm-up and thus slowing the warm-up.

The coolant throughput through the ventilation vessel should basically be as low as possible in particular at low coolant temperatures. The throughput should advantageously be completely prevented for as long as the coolant has not exceeded a predefinable minimum temperature. Firstly, a degassing process, that is to say a ventilation process, requires that the coolant is in the ventilation vessel for a certain residence time, for which reason the throughput should fundamentally be limited. Secondly, a low temperature of the coolant, or the higher viscosity of the coolant on account of the low temperature, has the effect that the coolant is enriched with air again as it flows out of the ventilation vessel—contrary to the actual objective. The latter is a basic problem with ventilation by means of ventilation vessels, but is particularly pronounced at low coolant temperatures, whereas toward higher temperatures, the re-enrichment of the coolant with air does not take place, or said effect can be disregarded. The coolant throughput likewise has an—albeit secondary—influence on the re-enrichment of the coolant with air, wherein an increasing throughput intensifies the effect.

The inventors herein have recognized the above issues and provide a liquid-cooled internal combustion engine to at least partly address the issues. Accordingly, a liquid-cooled internal combustion engine comprises at least one cylinder head configured to be connected at an assembly end side to a cylinder block; a cooling circuit including a pump for delivering coolant, a heat exchanger, and a ventilation vessel; at least one liquid-cooled component which is cooled when the internal combustion engine is not in operation by being connected into the cooling circuit of the internal combustion engine by a connecting line and being arranged between the pump and the ventilation vessel; and a valve which is self-controlling as a function of coolant pressure arranged in the connecting line between the pump and the ventilation vessel, the valve adjustable between a first working position, in which a first, relatively small cross section of the connecting line is opened up, and a second working position, in which a second, relatively large cross section of the connecting line is opened up, the valve controlling coolant throughput, wherein when the internal combustion engine is not in operation and coolant pressure is reduced, the valve is in the second working position in order to provide an enlarged flow cross section.

In this way, a liquid-cooled internal combustion engine, in which the afterrun cooling of the at least one liquid-cooled component which requires cooling when the internal combustion engine is not in operation, is optimized.

According to the disclosure, the flow cross section of the connecting line leading through the at least one liquid-cooled component is variable and is reduced when the internal combustion engine is in operation, because, owing to the high coolant pressure when the coolant pump is active, the valve which adjusts in a pressure-dependent manner is situated in the first working position and opens up only a relatively small cross section of the connecting line. Adequate cooling of the component is nevertheless ensured by the relatively small cross section in interaction with the high coolant pressure.

As a result of the transition from the second working position into the first working position, the valve reduces the coolant delivery via the connecting line when the internal combustion engine is in operation. The reduced coolant delivery has advantages in particular with regard to the problem of the re-enrichment of the coolant with air in the ventilation vessel.

When the internal combustion engine is switched off, the valve, owing to a reduced coolant pressure, switches from the first working position into the second working position, in which a relatively large cross section of the connecting line is opened up. As a result of enlargement of the flow cross section, the flow resistance in the connecting line is reduced. In this way, in turn, when the internal combustion engine is switched off, the delivery of coolant by means of the thermosiphon effect is assisted and adequate afterrun cooling when the internal combustion engine is out of operation, that is to say switched off, is ensured.

According to the disclosure, as a valve, use is made of a self-controlling valve which, as a function of the coolant pressure, varies the flow cross section of the connecting line and thereby controls the coolant throughput through the at least one liquid-cooled component, specifically in such a way that the cross section decreases with rising coolant pressure. Consequently, in the internal combustion engine according to the disclosure, it is the case not only that the coolant delivery when the internal combustion engine is in operation is reduced, but rather also that the coolant delivery and thus the cooling when the internal combustion engine is not in operation is forced, that is to say increased, by opening the valve, whereby improved afterrun cooling is realized. This results in a supply of coolant to the at least one liquid-cooled component according to demand, wherein the delivery of the coolant is based on the thermosiphon effect.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
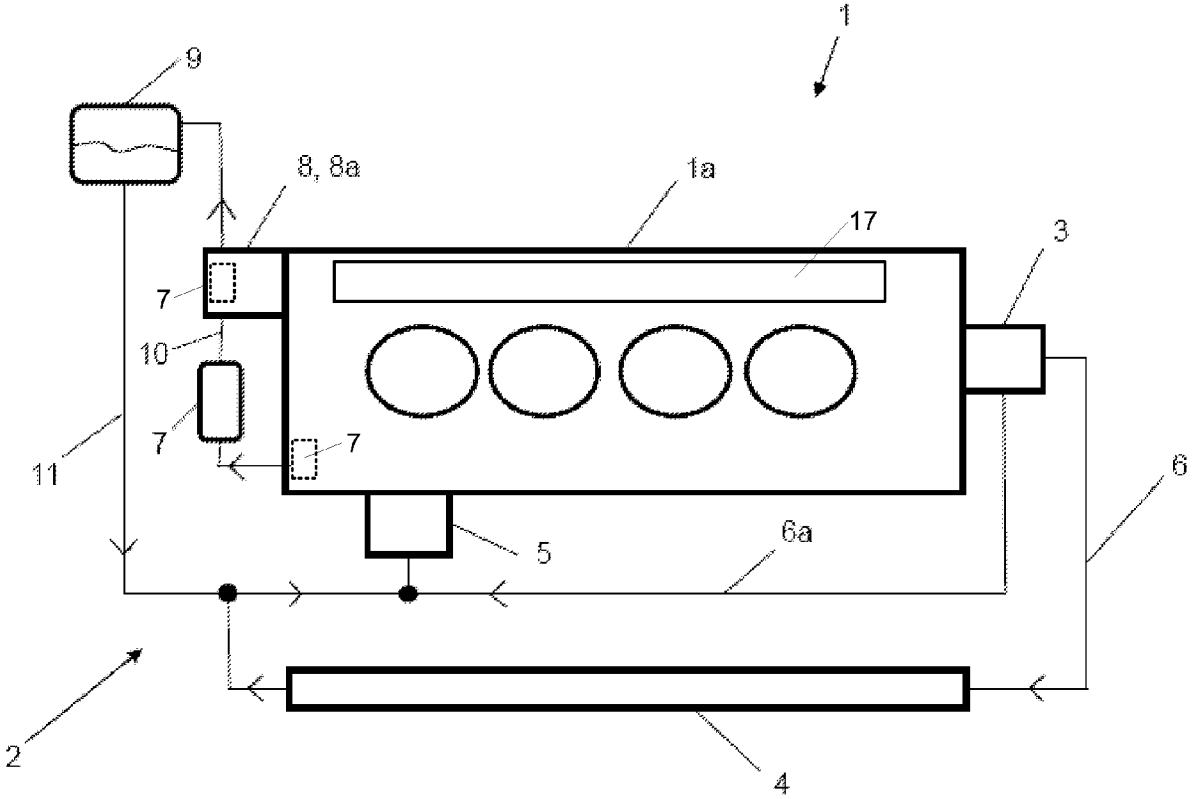
FIG. 1 schematically shows, in a diagrammatic sketch, a first embodiment of the liquid-cooled internal combustion engine together with the coolant flows.

In order to provide coolant to an engine component on demand, even after shut down of the engine, a pressure-sensitive valve may be arranged between a coolant pump and the engine component to be cooled. Coolant may flow from the pump to the valve and the component during pump operation. Then, after the engine is shut down and the pump operation ceases, coolant may continue to flow due to the thermosiphon effect. The valve may move to a position having an increased cross-section during operation with low coolant pressure in order to provide an adequate amount of coolant to the engine component. The valve may be positioned in a connecting line of a cooling circuit of an engine upstream of a ventilation vessel.

The valve is arranged in the connecting line, wherein within the context of the present disclosure, the entire line section between the pump and the ventilation vessel is referred to as a connecting line, specifically regardless of whether the line leads through other components or assemblies such as for example the cylinder head, the cylinder block or the bearing housing of an exhaust-gas turbocharger.

Embodiments of the internal combustion engine are advantageous in which, for the supercharging of the internal combustion engine, at least one exhaust-gas turbocharger is provided in which a compressor and a turbine are arranged on the same shaft.

The advantage of the exhaust-gas turbocharger for example in relation to a mechanical charger is that no mechanical connection for transmitting power is required between the charger and internal combustion engine. While a mechanical charger extracts the energy required for driving it entirely from the internal combustion engine, and thereby reduces the output power and consequently adversely affects the efficiency, the exhaust-gas turbocharger utilizes the exhaust-gas energy of the hot exhaust gases.

Supercharged internal combustion engines are commonly equipped with a charge-air cooling arrangement by means of which the compressed combustion air is cooled before it enters the cylinders. In this way, the density of the supplied charge air is increased further. In this way, the cooling likewise contributes to a compression and improved charging of the combustion chambers, that is to say to an improved volumetric efficiency.

Supercharging is a suitable means for increasing the power of an internal combustion engine while maintaining an unchanged swept volume, or for reducing the swept volume while maintaining the same power. In any case, supercharging leads to an increase in volumetric power output and an improved power-to-weight ratio. For the same vehicle boundary conditions, it is thus possible to shift the load collective toward higher loads, at which the specific fuel consumption is lower.

Problems are encountered in the configuration of the exhaust-gas turbocharging, wherein it is basically sought to obtain a noticeable performance increase in all rotational speed ranges. A severe torque drop is commonly observed in the event of a certain rotational speed being undershot. It has been attempted through various measures to improve the torque characteristic of a supercharged internal combustion engine, for example by virtue of a plurality of superchargers—exhaust-gas turbochargers and/or mechanical superchargers—being provided in a parallel and/or series arrangement in the exhaust-gas discharge system.

Embodiments of the internal combustion engine are advantageous in which the at least one exhaust-gas turbocharger is the at least one liquid-cooled component which requires afterrun cooling when the internal combustion engine is not in operation.

In this connection, embodiments of the internal combustion engine are advantageous in which the shaft of the at least one exhaust-gas turbocharger is rotatably mounted in a liquid-cooled bearing housing. The connecting line then leads through the liquid-cooled bearing housing.

Embodiments of the internal combustion engine may also be advantageous in which an exhaust manifold which is integrated into the at least one cylinder head is the at least one liquid-cooled component which requires afterrun cooling when the internal combustion engine is not in operation.

In the case of internal combustion engines having at least two cylinders, in which each cylinder has at least one outlet opening for discharging the exhaust gases out of the cylinder and each outlet opening is adjoined by an exhaust line, embodiments are advantageous specifically in which the exhaust lines of at least two cylinders merge to form at least one overall exhaust line within the cylinder head, so as to form at least one exhaust manifold.

As a result of the merging of the exhaust lines within the cylinder head, the overall length of the exhaust lines is reduced, and the line volume of the exhaust manifold is reduced. The merging of the exhaust lines within the cylinder head permits dense packaging of the drive unit.

Advantages are gained in the case of exhaust-gas turbocharging because the turbine can be arranged in a close-coupled position, whereby the exhaust-gas enthalpy of the hot exhaust gases, which is determined significantly by the exhaust-gas pressure and the exhaust-gas temperature, can be utilized optimally, and a fast response behavior of the turbine or of the turbocharger is ensured. Furthermore, the path of the hot exhaust gases to the different exhaust-gas aftertreatment systems is short, whereby the exhaust gases are given little time to cool down and the exhaust-gas aftertreatment systems reach their operating temperature or light-off temperature quickly, in particular after a cold start of the internal combustion engine.

That which has been stated above also applies to internal combustion engines having three and more cylinders, in which at least three cylinders are configured in such a way as to form two groups with in each case at least one cylinder, and the exhaust lines of the cylinders of each cylinder group merge in each case into an overall exhaust line so as to form an exhaust manifold.

Said embodiment is suitable in particular for the use of a twin-channel turbine which has an inlet region with two inlet ducts. The merging of the two exhaust-gas flows which are conducted in the overall exhaust lines takes place if appropriate downstream of the turbine. The grouping of the cylinders or exhaust lines however also offers advantages for the use of a plurality of turbines or exhaust-gas turbochargers, wherein in each case one overall exhaust line can be connected to one turbine.

Embodiments of the internal combustion engine are advantageous in which the valve is integrated into the at least one liquid-cooled component. In said embodiment, the valve reacts to the pressure in the component. Parts of the valve, for example the valve housing, may be jointly formed by the component. This yields further advantages, in particular a compact design and a weight saving.

In embodiments in which the bearing housing of an exhaust-gas turbocharger is liquid-cooled, it may be advantageous for the valve to be integrated into the liquid-cooled bearing housing.

Embodiments of the internal combustion engine may also be advantageous in which the valve is integrated into the internal combustion engine. Advantages are obtained with regard to packaging and weight, as already described in conjunction with the above embodiment, for which reason reference is made to the corresponding statements.

Embodiments of the internal combustion engine are advantageous in which the connecting line is formed as a rising line. To utilize or improve the thermosiphon effect, it is advantageous for the connecting line to be formed, at least upstream of the component, as a rising line in which the geodetic height continuously increases.

Embodiments of the internal combustion engine are advantageous in which the connecting line issues into the ventilation vessel, which aside from a volume of liquid coolant also comprises a gas volume, at a location charged with liquid coolant.

In the present case, the connecting line issues below the surface level of the liquid coolant in the ventilation vessel, that is to say the intensely superheated and possibly gaseous coolant passing from the component is delivered utilizing the thermosiphon effect into the volume of liquid coolant situated in the ventilation vessel. Whereas an introduction of the superheated coolant above the coolant level would result in the interior wall of the ventilation vessel being directly subjected to high thermal loading and possible damage, it is the case if the superheated coolant is fed in below the surface level that direct mixing takes place with the liquid coolant already situated in the vessel, wherein the mixture temperature that is generated is significantly lower than the temperature of the superheated coolant. Consequently, by the proposed measure, specifically the configuration of the connecting line such that it issues into the cooling liquid in the ventilation vessel below the surface level, the thermal loading of the vessel is reduced considerably.

Nevertheless, embodiments may be advantageous in which the connecting line issues into the gas volume of the ventilation vessel.

Embodiments of the internal combustion engine are advantageous in which the valve is arranged upstream of the at least one liquid-cooled component in the connecting line.

The valve used according to the disclosure is actuated, that is to say controlled, by means of the coolant pressure. In particular if the connecting line is formed as a rising line and the pressure decreases in the flow direction, that is to say in the direction of the ventilation vessel, it is advantageous for the valve to be arranged upstream of the at least one liquid-cooled component in the connecting line in order to increase the coolant throughput when the internal combustion engine is in operation.

In the case of a valve arranged downstream of the component, there is inevitably a lower coolant throughput owing to the fact that the pressure level is lower downstream and higher upstream.

Nevertheless, embodiments of the internal combustion engine may also be advantageous in which the valve is arranged downstream of the at least one liquid-cooled component in the connecting line.

Embodiments of the internal combustion engine are advantageous in which the connecting line leads through the cylinder block.

In the installed position, the cylinder block is generally arranged low in the engine bay, that is to say at a geodetic height which is low in relation to the ventilation vessel. If the connecting line then leads through the cylinder block upstream of the component, this is advantageous in particular with regard to the utilization of the thermosiphon effect and the formation of the connecting line as a rising line.

Embodiments of the internal combustion engine may however also be advantageous in which the connecting line leads through the cylinder head.

In the case of internal combustion engines in which for example the turbine of an exhaust-gas turbocharger is arranged above the cylinder block, on that side of the assembly end side which faces toward the cylinder head, the connecting line may also lead from the cylinder head to the bearing housing of the turbine without the need to dispense with the formation of the line as a rising line. The arrangement of the turbine above the assembly end side makes it possible for even large-volume exhaust-gas aftertreatment systems to be located in a close-coupled position downstream of the turbine.

Embodiments of the internal combustion engine are advantageous in which the valve is continuously adjustable. A continuously adjustable valve correspondingly follows the coolant pressure presently prevailing in the connecting line and continuously varies the coolant throughput.

Embodiments of the internal combustion engine may however also be advantageous in which the valve can be switched in a two-stage fashion. Said embodiment is characterized in that the valve can be switched only between the first working position and the second working position, that is to say can assume only two switching states. Cost advantages are obtained in relation to the above embodiment.

The method for operating a liquid-cooled internal combustion engine of an above-described type may be achieved by means of an operating method in which the valve is self-adjusting as a function of the coolant pressure, whereby the coolant throughput is controlled and varied, the flow cross section opened up by the valve being increased in size with decreasing coolant pressure.

That which has been stated in connection with the internal combustion engine according to the disclosure likewise applies to the method according to the disclosure.

By means of the method according to the disclosure, the afterrun cooling when the internal combustion engine is switched off is improved. Overheating of a thermally highly loaded component which requires cooling when the internal combustion engine is not in operation, for example of an integrated manifold and/or of an exhaust-gas turbocharger or the bearing housing thereof, is reliably prevented.

It is not the aim and the purpose of a liquid-type cooling arrangement to extract the greatest possible amount of heat from the component under all operating conditions. Rather, cooling according to demand is desired. In the present case, during the operation of the internal combustion engine, the coolant delivery via the component is reduced or restricted in the case of high coolant pressure by a valve positioned in the first working position. When the internal combustion engine is switched off, by means of a valve in the second working position, a relatively large cross section of the connecting line is opened up such that the flow resistance in the connecting line is reduced and thereby in turn the delivery of coolant is forced in the case of low coolant pressure.

Embodiments of the operating method are advantageous in which, when the internal combustion engine is not in operation, the valve is, owing to a reduced coolant pressure, situated in the second working position in order to increase the coolant throughput via the connecting line.

Turning now to the drawings, FIG. 1 schematically shows, in a diagrammatic sketch, a first embodiment of the liquid-cooled internal combustion engine 1 together with the coolant flows (indicated by arrows). Within the context of the present disclosure, the expression "internal combustion engine" encompasses diesel engines, spark-ignition engines and also hybrid internal combustion engines.

To form the engine cooling circuit 2, a pump 5 is provided upstream of the engine block 1*a*, by means of which pump coolant is delivered through a cooling circuit 2. Here, the coolant flows through the engine block 1*a* and, downstream of the engine block 1*a*, is supplied back to the pump 5 via a return line 6, and the cooling circuit 2 is thereby closed. In the return line 6 there is arranged a radiator 4 which serves as a heat exchanger 4 and which extracts heat from the coolant. If the coolant has not yet exceeded a predefinable minimum temperature, for example after a cold start of the internal combustion engine 1, the return line 6 is blocked by means of a thermostat valve 3 and, instead of said return line, a bypass line 6*a* is opened up which supplies the coolant to the pump 5 while bypassing the heat exchanger 4, whereby the warm-up of the internal combustion engine 1 is accelerated. The cooling circuit 2, in the present case the engine block 1*a*, is connected via a connecting line 10 to a ventilation vessel 9 from which the coolant is supplied via a ventilation line 11 back to the cooling circuit 2 by being introduced into the cooling circuit 2 upstream of the pump 5.

For the supercharging of the internal combustion engine 1, an exhaust-gas turbocharger 8 is provided which comprises a compressor and a turbine which are arranged on a common shaft. The shaft is rotatably mounted in a liquid-cooled bearing housing 8*a*. The bearing housing 8*a* is a liquid-cooled component which requires afterrun cooling.

To form the afterrun cooling arrangement, the bearing housing 8*a* is connected into the cooling circuit 2 of the internal combustion engine 1 and is arranged between the pump 5 and the ventilation vessel 9. In the embodiment illustrated in FIG. 1, the connecting line 10 in which the bearing housing 8*a* is arranged leads through the engine block 1*a*. A valve 7 which is self-controlling as a function of the coolant pressure is arranged in the connecting line 10 upstream of the bearing housing 8*a*, which valve serves for controlling the flow cross section Q and thus the coolant throughput. The internal combustion engine 1 includes an exhaust manifold 17, which may be integrated in the cylinder head. In some examples, exhaust manifold 17 may cooled when the engine is not in operation via the cooling circuit 2. In some examples, valve 7 may alternatively be arranged in the bearing housing 8*a* or in the internal combustion engine 1, such as in the cylinder block 1*a*.

Figure 2B:
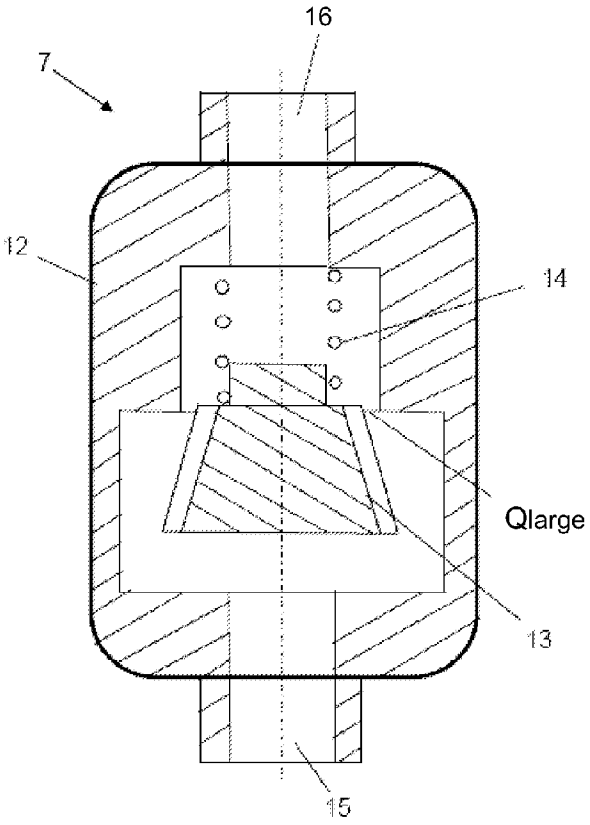
FIG. 2*b* schematically shows the valve of the embodiment illustrated in FIG. 1 in a second working position.
Figure 2A:
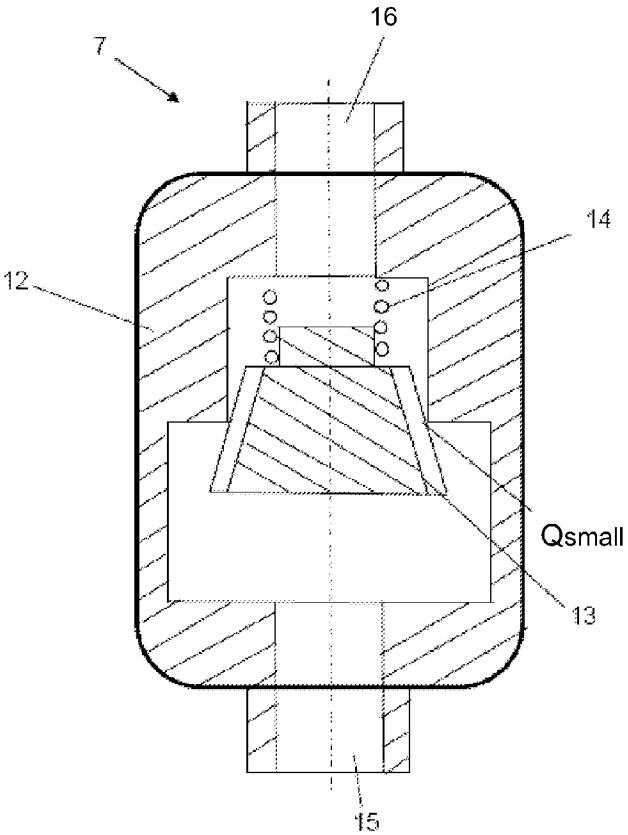
FIG. 2*a* schematically shows the valve of the embodiment illustrated in FIG. 1 in a first working position.

The mode of operation of the valve 7 will be explained in more detail on the basis of FIGS. 2*a* and 2*b*. FIG. 2*a* schematically shows the valve 7 of the internal combustion engine 1 illustrated in FIG. 1 in a first working position, whereas FIG. 2*b* schematically shows the same valve 7 in a second working position.

The valve 7 is a self-controlling valve 7 which, as a function of the coolant pressure, opens up a more or less large flow cross section Q of the connecting line 10.

The valve 7 comprises a valve housing 12 which has an inlet 15 and an outlet 16 for the coolant and in which a control piston 13 is arranged such that it can move in a translatory manner. The control piston 13 has a frustoconical basic shape, such that the pressure exerted on the control piston 13 by the coolant leads to a resultant force which acts along an axis in the movement direction. Said resultant pressure force counteracts a spring force exerted by a spring element 14 on which the control piston 13 is supported. By virtue of the fact that the frustoconical control piston 13 has recesses on its lateral surface which run between the end sides, the control piston 13 opens up a small flow cross section $Q_{small}$ even when abutting against the recess which receives the spring element 14. Said position characterizes the first working position of the valve 7 when the internal combustion engine is in operation. The valve 7 is situated in said first working position owing to the high coolant pressure when the coolant pump is being driven. Adequate cooling of the bearing housing is ensured by the relatively small cross section $Q_{small}$ in interaction with the high coolant pressure.

When the internal combustion engine is switched off, the valve 7, owing to a reduced coolant pressure, switches from the first working position (FIG. 2*a*) into the second working position (FIG. 2*b*), in which a relatively large flow cross section $Q_{large}$ is opened up. As a result of an increase of the flow cross section, the flow resistance in the valve 7 itself and thus in the connecting line is reduced, whereby the coolant throughput based on the thermosiphon effect is increased. Improved afterrun cooling when the internal combustion engine is switched off is realized.

Figure 3:
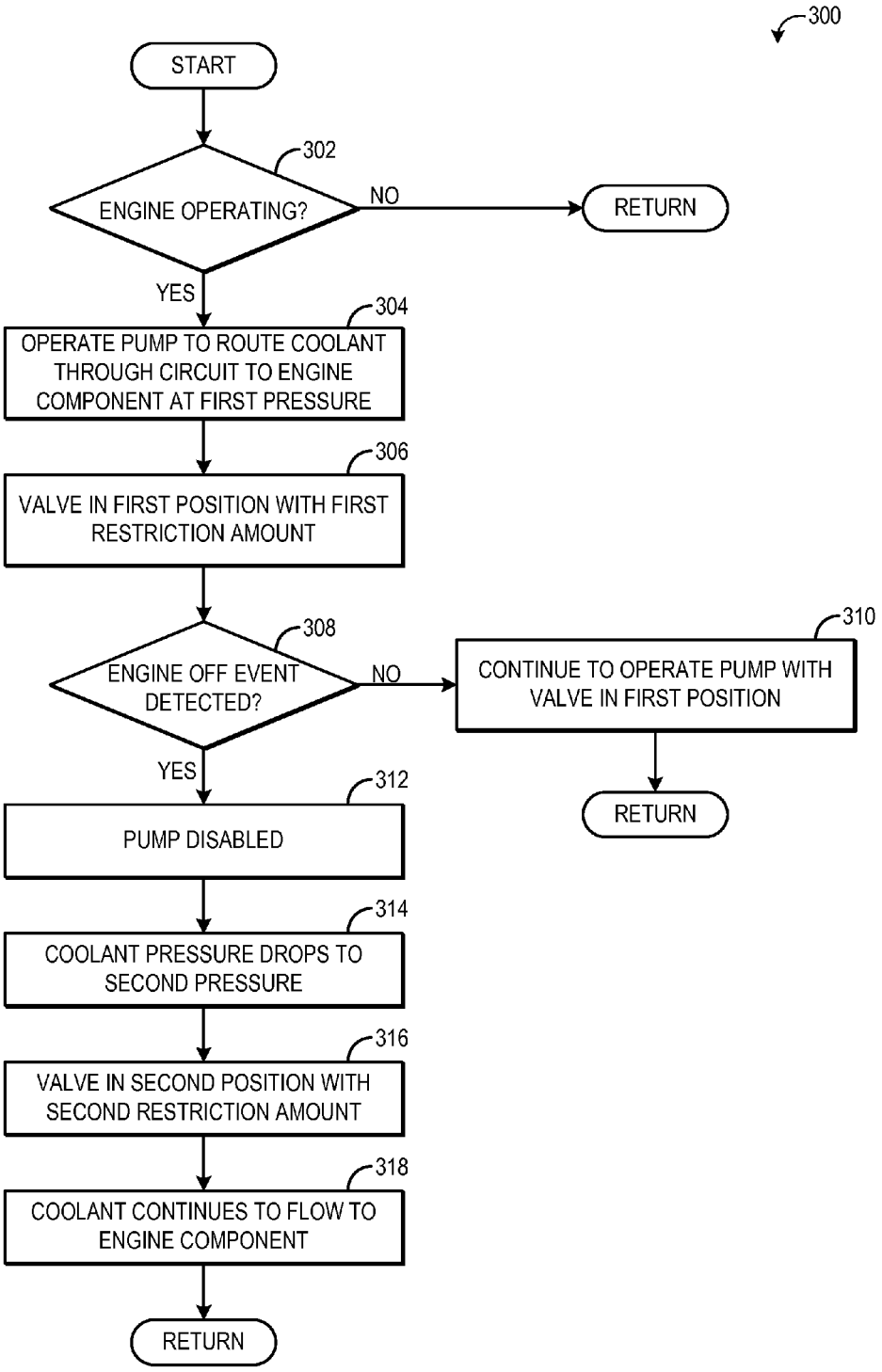
FIG. 3 is a flow chart illustrating a method for cooling an engine component according to an embodiment of the disclosure.

FIG. 3 illustrates a method 300 for routing coolant in a coolant circuit according to an embodiment of the present disclosure. Method 300 may be performed in an engine cooling circuit, such as the circuit 2 of FIG. 1, to cool an engine component, such as the turbocharger 8. At 302, method 300 includes determining if the engine is running Determining if the engine is running may include determining engine speed, ignition key status, fuel injection status, or other suitable measures for determining if an engine is operating (e.g., if combustion is occurring and the engine is spinning) If the engine is not running, method 300 returns.

If the engine is running, at 304, the coolant pump (e.g., pump 5) is operated and coolant is routed through the circuit to the engine component at a first pressure. For example, according to the configuration of FIG. 1, the pump 5 is operated (via operation of a motor or via a mechanical coupling the engine) and coolant flows through a connecting line 10 to the turbocharger 8 via the valve 7 before returning to the pump 5 (after flowing through the ventilation vessel 9). Due to operation of the pump, the coolant flows at a relatively high pressure. As such, as indicated at 306, the valve is in the first position with the first, higher amount of restriction.

At 308, it is determined if an engine off event has been detected. This may include detection of a key off event. If an engine off event is not detected, method 300 proceeds to 310 to continue to operate pump and route coolant through the circuit with the valve in the first position. If an engine off event is detected, method 300 proceeds to 312, where the pump is disabled. The pump may be disabled by deactivation of a motor driving the pump, or may be disabled as a result of the engine shutting down (and thus the pump is no longer driven via the mechanical coupling to the engine). As a result of the disabled pump, at 314, the coolant pressure drops to a second, lower pressure. As explained previously, without operation of the coolant pump, coolant may continue to flow through the circuit, at least initially, at a low pressure. At 316, the valve moves into the second position. The second position has a second, smaller amount of restriction. In other words, the lowered coolant pressure causes the valve to move from the first to the second position. The second position has a larger cross-section and thus provides a smaller amount of restriction to the coolant flow. At 318, coolant continues to flow the engine component.

Thus, the method 300 described above provides for routing coolant in a cooling circuit to cool an engine component, such as a turbocharger bearing housing. Such engine component may require continued cooling after cessation of engine operation. To provide continued cooling, a valve positioned in the cooling circuit upstream of the engine component may increase the cross-section of its orifice responsive to a drop in coolant pressure resulting from the cessation of engine operation (and thus disabling of the coolant pump driving flow through the cooling circuit). Due to the thermosiphon effect, coolant may continue to flow in the circuit immediately following engine shutdown. The increased cross-section of the valve, and thus reduced restriction of the current flow, ensures adequate coolant reaches the engine component.

In an embodiment, a method comprises, during engine running conditions, restricting a flow of coolant by a first restriction amount, the coolant flowing in a cooling circuit to an engine component; and following an engine off event, restricting the flow of coolant by a second restriction amount, smaller than the first restriction amount.

The engine component may be a suitable component that is provided with coolant even after engine shutdown, such as a turbocharger turbine, turbocharger bearing housing, etc. To restrict the coolant flow by the first amount, a valve positioned in the cooling circuit may be positioned in a first position during engine operation, when coolant pressure is high due to operation of the coolant pump. Then, to restrict the flow by the second amount, the valve moves to the second position when the coolant pressure drops after the pump is disabled. The second position has a larger cross-section than the first position, thus providing a smaller restriction to the flow of coolant.

While method 300 is performed in a cooling circuit with a pressure-sensitive valve that responds mechanically to changes in coolant pressure (as described above with respect to FIGS. 2*a* and 2*b*), in some embodiments the valve may be controlled by an engine controller to be in the first position during engine operation, and then the controller may move the valve to the second position responsive to the engine shutting down.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A liquid-cooled internal combustion engine comprising:

at least one cylinder head configured to be connected at an assembly end side to a cylinder block;

a cooling circuit including a pump for delivering coolant, a heat exchanger, and a ventilation vessel;

at least one liquid-cooled component which is cooled when the internal combustion engine is not in operation by being connected into the cooling circuit of the internal combustion engine by a connecting line and being arranged between the pump and the ventilation vessel; and a valve which is self-controlling as a function of coolant pressure arranged in the connecting line between the pump and the ventilation vessel, the valve adjustable based on coolant pressure between a first working position, in which a first cross section of the connecting line is opened up to provide coolant flow with a first restriction amount to the at least one liquid-cooled component, and a second working position, in which a second cross section of the connecting line is opened up to provide coolant flow with a second restriction amount to the at least one liquid-cooled component, the valve controlling coolant throughput, wherein when the internal combustion engine is in operation, the valve is in the first working position, and when the internal combustion engine is not in operation and coolant pressure is reduced, the valve is in the second working position in order to provide an enlarged flow cross section.

2. The liquid-cooled internal combustion engine as claimed in claim 1, further comprising at least one exhaust-gas turbocharger including a compressor and a turbine arranged on a same shaft.

3. The liquid-cooled internal combustion engine as claimed in claim 2, wherein the at least one liquid-cooled component which is cooled when the internal combustion engine is not in operation comprises the at least one exhaust-gas turbocharger.

4. The liquid-cooled internal combustion engine as claimed in claim 3, wherein the shaft of the at least one exhaust-gas turbocharger is rotatably mounted in a liquid-cooled bearing housing.

5. The liquid-cooled internal combustion engine as claimed in claim 4, wherein the valve is integrated into the bearing housing.

6. The liquid-cooled internal combustion engine as claimed in claim 1, wherein the valve is integrated into the at least one liquid-cooled component.

7. The liquid-cooled internal combustion engine as claimed in claim 1, wherein the valve is integrated into the internal combustion engine.

8. The liquid-cooled internal combustion engine as claimed in claim 1, wherein the at least one liquid-cooled component which is cooled when the internal combustion engine is not in operation comprises an exhaust manifold which is integrated into the at least one cylinder head.

9. The liquid-cooled internal combustion engine as claimed in claim 1, wherein the connecting line is formed as a rising line, wherein the valve is configured to be switched in a two-stage fashion, and wherein the valve is arranged upstream of the at least one liquid-cooled component in the connecting line.

10. The liquid-cooled internal combustion engine as claimed in claim 1, wherein the valve is arranged downstream of the at least one liquid-cooled component in the connecting line, and wherein the connecting line leads through the cylinder block.

11. The liquid-cooled internal combustion engine as claimed in claim 1, wherein the connecting line leads through the cylinder head, and wherein the valve is continuously adjustable.

12. An operating method for a valve of a cooling circuit of a liquid-cooled internal combustion engine, the valve arranged in a connecting line between a coolant pump and a ventilation vessel and configured to control coolant flow to at least one liquid-cooled component which is cooled when the internal combustion engine is not in operation by being connected into the cooling circuit by the connecting line and being arranged between the coolant pump and the ventilation vessel, the method comprising:

flowing coolant to the at least one liquid-cooled component via the valve in a first working position; and self-adjusting the valve from the first working position to a second working position as a function of coolant pressure, whereby coolant throughput is controlled and varied, and where a flow cross section opened up by the valve is increased in size with decreasing coolant pressure.

13. The operating method as claimed in claim 12, wherein, when the internal combustion engine is not in operation, responsive to reduced coolant pressure, self-adjusting the valve to the second working position in order to increase the coolant throughput via the connecting line.

14. A method, comprising:

during engine running conditions, flowing coolant in a coolant circuit to an engine component while a flow of the coolant is restricted by a first restriction amount;

and following an engine off event, restricting the flow of coolant by a second restriction amount, less restrictive than the first restriction amount;

wherein flowing coolant while the flow of coolant is restricted by the first restriction amount comprises, responsive to a first coolant pressure during engine running conditions, flowing the coolant through a valve in a first working position, the valve positioned in the coolant circuit upstream of the engine component, and wherein restricting the flow of coolant by the second restriction amount comprises, responsive to a drop in coolant pressure to a second coolant pressure following the engine off event, opening the valve to a second working position.

15. The method of claim 14, wherein the engine component comprises a bearing housing of a turbocharger, and the second restriction amount is a larger opening area than the first restriction amount.

16. The method of claim 14, wherein the coolant pressure is controlled by coolant pump enablement and disablement.

17. The method of claim 16, wherein a coolant pump is mechanically coupled to an engine.

18. The method of claim 14, wherein following the engine off event, coolant flows to the engine component via a thermosiphon effect.

19. The method of claim 14, wherein the coolant continues to flow to the engine component during the engine off events.

* * * * *